US009139342B2

(12) United States Patent
Cappello

(10) Patent No.: US 9,139,342 B2
(45) Date of Patent: Sep. 22, 2015

(54) INSERT FOR CROWN OR SCREW CAPS FOR THE CLOSURE OF BOTTLES

(75) Inventor: Giovanni Cappello, Bosco (IT)

(73) Assignee: CAPELLO SRL., S. Giorgio in Bosco (PD) (IT)

( * ) Notice: Subject to any disclaimer, the term of this patent is extended or adjusted under 35 U.S.C. 154(b) by 750 days.

(21) Appl. No.: 12/293,804

(22) PCT Filed: Mar. 21, 2007

(86) PCT No.: PCT/IT2007/000208

§ 371 (c)(1),
(2), (4) Date: Oct. 13, 2008

(87) PCT Pub. No.: WO2007/108037

PCT Pub. Date: Sep. 27, 2007

(65) Prior Publication Data

US 2010/0163511 A1 Jul. 1, 2010

(30) Foreign Application Priority Data

Mar. 21, 2006 (IT) ..... PD2006A0101

(51) Int. Cl.
*B65D 51/16* (2006.01)

(52) U.S. Cl.
CPC ..... *B65D 51/1616* (2013.01)

(58) Field of Classification Search
CPC ..... B65D 51/1616
USPC ..... 215/261, 328, 341; 220/203.17, 203.16
See application file for complete search history.

(56) References Cited

U.S. PATENT DOCUMENTS

| | | | | |
|---|---|---|---|---|
| 2,726,002 | A * | 12/1955 | Dalianis | 215/260 |
| 3,071,276 | A * | 1/1963 | Pellett et al. | 215/261 |
| 3,951,293 | A | 4/1976 | Schulz | |
| 5,914,154 | A * | 6/1999 | Nemser | 427/245 |
| 2006/0246273 | A1 * | 11/2006 | McKeown et al. | 428/314.8 |

FOREIGN PATENT DOCUMENTS

| | | | |
|---|---|---|---|
| DE | 1295468 | B | 5/1969 |
| DE | 29706798 | U1 | 7/1997 |
| FR | 1220599 | A | 5/1960 |
| FR | 1543633 | A | 10/1968 |

OTHER PUBLICATIONS

PCT International Search Report and Written Opinion (PCT/IT2007/000208).

* cited by examiner

*Primary Examiner* — Jeffrey Allen
(74) *Attorney, Agent, or Firm* — Kristina Castellano; Castellano PLLC.

(57) ABSTRACT

An insert (8) for a screw (1) or crown (1') cap for the closure of bottles (10) is described, the said cap (1, 1') including a body (2) and the insert (8) being designed to be fixed to the body facing the interior of the bottle (10) when the cap (1, 1') is closed over the said bottle. The insert (8) comprises a sealing element (9) capable of being compressed in one part between the body and a portion of the bottle (10) when the cap (1, 1') is closed over the bottle, as well as a permeating element (16, 109, 209), connected to the sealing element, impermeable to liquids and having a permeability to oxygen measured at 20° C. of between $10^{-6}$ and $10^{-10}$ (Ncm3*cm/cm2*cmHg*s), which is designed to close a passage made in the said cap between the inside and outside of the bottle, in order to control the flow of oxygen between the inside and outside of the bottle.

32 Claims, 4 Drawing Sheets

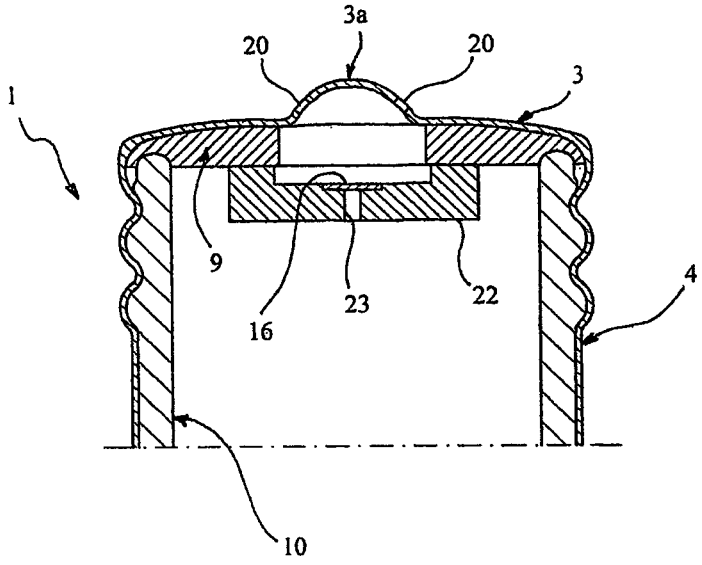
Fig. 5
Fig. 6a
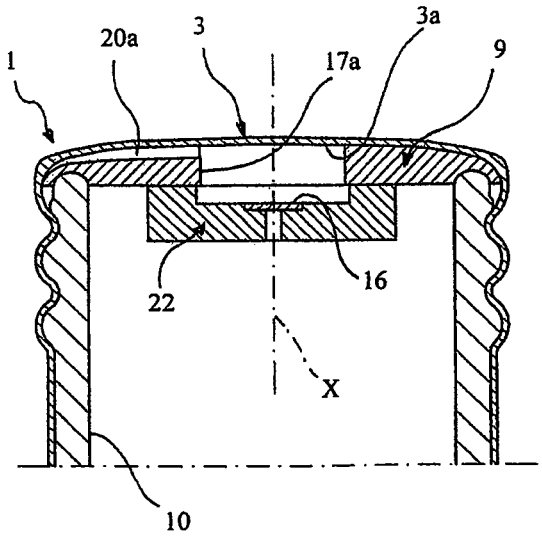
Fig. 6b
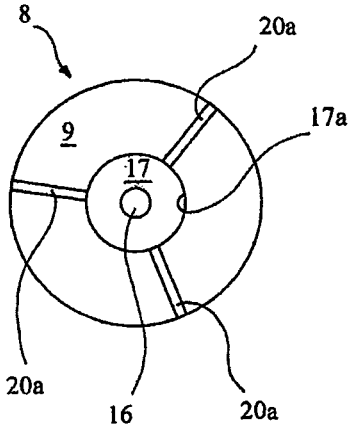

INSERT FOR CROWN OR SCREW CAPS FOR THE CLOSURE OF BOTTLES

CLAIM FOR PRIORITY

This application is a U.S. National Stage Application of PCT/IT2007/000208 filed on Mar. 21, 2007, claiming priority to Italian application PD2006A000101 filed Mar. 21, 2006, the contents of both of which are incorporated herein by reference.

TECHNICAL FIELD

The present invention concerns an insert for crown or screw caps for the closure of bottles, as well as a screw or crown cap comprising such an insert.

TECHNOLOGICAL BACKGROUND

In the technical sector of the bottling of drinks, the use of mechanical clamping caps, typically of the screw or crown type and generally made of plastics material or metal, is known for the substantially hermetic sealing of bottles containing a variety of liquids. The hermetic seal is ensured by a seal, made for example of a plastics material, which is usually fixed to the surface of the cap that is facing the interior of the bottle.

These caps are particularly advantageous due to their relatively low cost and because they ensure a substantial seal.

In the specific sector of bottles of wine, the use of these caps substantially reduces the problem of the transfer of undesirable substances by common corks. In fact, the latter can damage a high percentage of bottles due to the release of trichloroanisole contained in the cork which causes the particular and undesirable taste and smell known by the term "corked". Moreover, as cork is a natural material that has very variable weight and density, and consequently sealing and permeability, characteristics, its properties are "non-standard" and, in the case for example of bottles of wine, it may occur that, due to a poor hermetic seal of the corks, the content oxidises prematurely thus spoiling the taste.

Crown or screw caps, however, precisely because of their hermetic seal, are not usually recommended for the bottling of certain wines which, in order to age from an organoleptic point of view, require an exchange of air between the interior of the bottle and the exterior. They are used rather for bottling wines intended for more immediate consumption, in which this ageing period is not required. The use of hermetic caps for wines intended for long periods of ageing in the bottle would give rise to reduction processes which would compromise the organoleptic characteristics of the wine.

DESCRIPTION OF THE INVENTION

The problem that lies at the heart of the present invention is to create an insert for screw or crown caps for the closure of bottles, as well as a cap comprising such an insert, structurally and functionally designed to overcome the above-mentioned limits with reference to the existing prior art.

This problem is solved by the present invention by means of an insert and a cap made in accordance with the claims below.

BRIEF DESCRIPTION OF THE DRAWINGS

Further features and advantages of the invention will emerge from the following detailed description of some of its preferred embodiments, shown by way of non-limiting examples in the accompany drawings, in which:

FIG. 5 is a longitudinal-section schematic view of a first variant of the cap with insert shown in FIG. 1 or 2;

FIG. 6*a* is a longitudinal-section schematic view of a second variant of the cap with insert shown in FIG. 1 or 2;

FIG. 6*b* is a schematic top plan view of the insert of the cap shown in FIG. 6*a;*

PREFERRED EMBODIMENTS OF THE INVENTION

Figure 1:
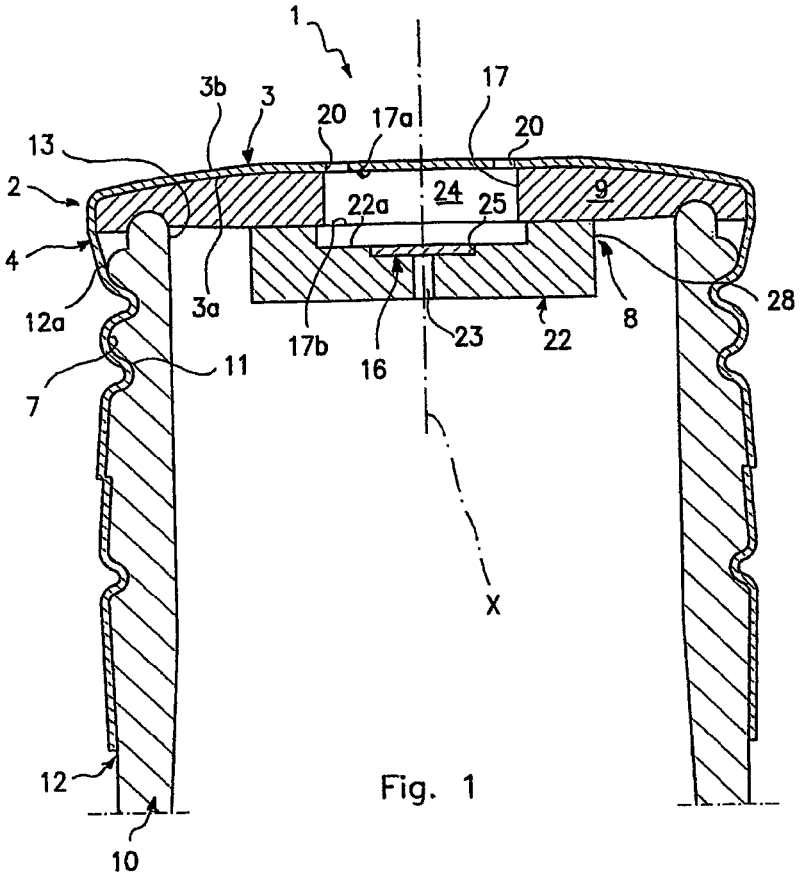
FIG. 1 is a longitudinal-section schematic view of a first preferred embodiment of a cap with an insert made according to the present invention.
Figure 2:
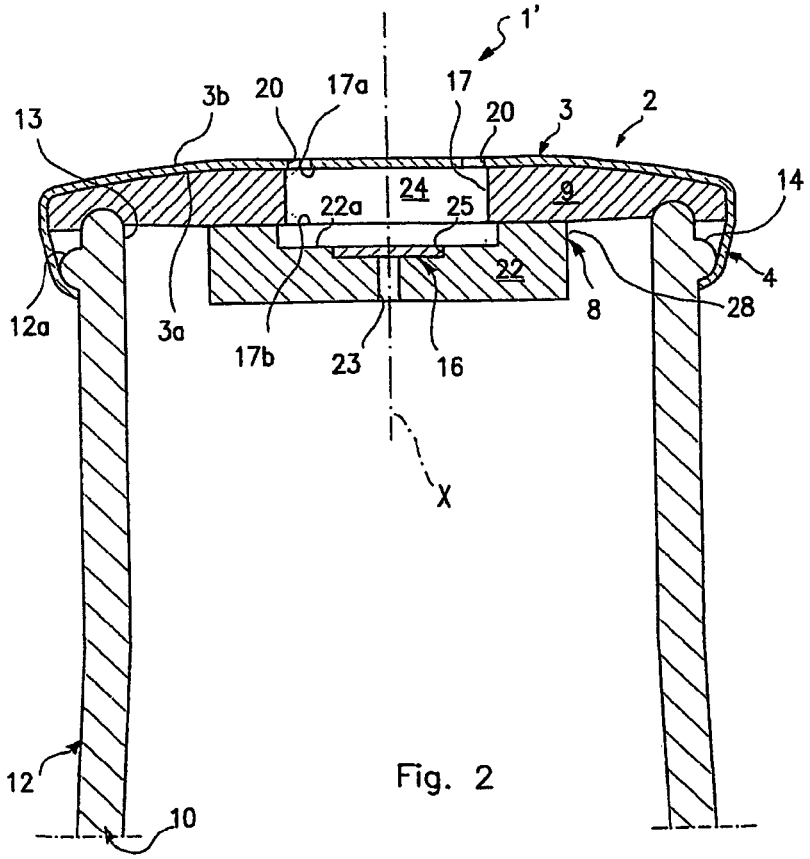
FIG. 2 is a longitudinal-section schematic view of a second preferred embodiment of a cap with an insert made according to the present invention.
Figure 3:
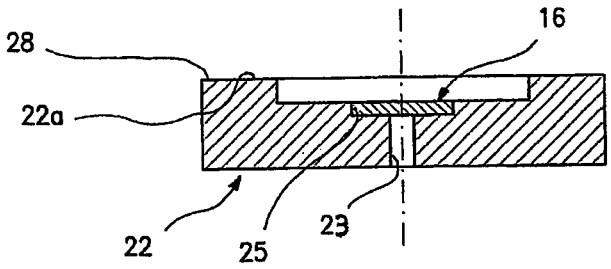
FIG. 3 is a longitudinal-section schematic view on an enlarged scale of a component of the insert fitted into the cap shown in FIG. 1 or 2.
Figure 4:
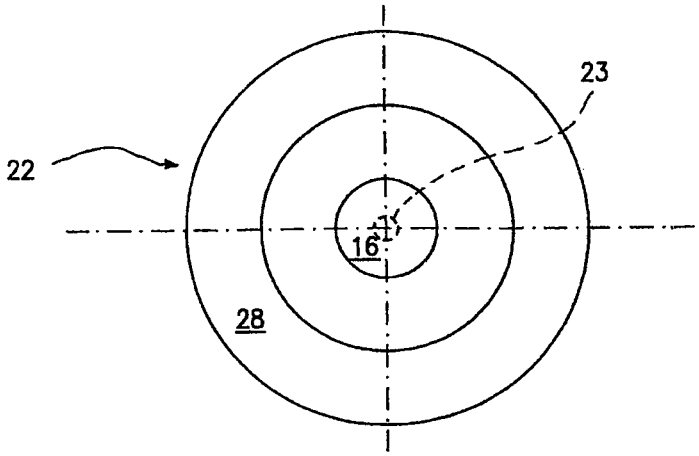
FIG. 4 is a top plan view of the component shown in FIG. 3.

In FIGS. 1 and 2, 1 and 1' indicate as a whole a mechanical clamping cap of the screw and crown type respectively, made according to the present invention, designed to close a bottle 10 of wine or another liquid that requires a controlled exchange of air with the environment outside the bottle over a prolonged period of time, for example wine to be matured.

The bottle 10 (of which only the top portion is shown in the accompanying figures) for which the cap 1, 1' acts as a closing device, may have any other type of shape or capacity. In addition, it may be made of any suitable material (e.g. glass, paper, PET, plastics material, etc.), with a preference for glass and ceramic. The bottle usually includes a hollow neck 12 terminating at its end 12a with an opening 13 for the egress of the liquid contained inside it. The mechanical clamping cap 1,1' is capable of engaging round the neck 12 so as to close the opening 13, in particular it engages round the outside of the bottle 10, unlike corks which engage inside the bottle.

The cap 1, 1' comprises a body 2, generally made of a sheet of metal, such as steel, aluminium or plastics material, including a substantially flat upper portion 3, from the periphery of which extends a side portion 4, angled in relation to the upper portion 3, and capable of securing the cap 1, 1' to the bottle 10. The upper portion 3 defines two opposing surfaces 3*a* and 3*b* called inner and outer respectively, which represent the surfaces facing the inner and outer environment of the bottle 10 respectively, when the latter is closed by the cap 1,1'. In addition, the upper portion 3 is preferably disc-shaped and of a known thickness and conformation.

The side and upper portions 4 and 3 can be made either in one piece, in a conventional manner, or one can be fixed onto the other, for example by welding. Furthermore, the upper and side portions 3, 4 can be made of the same material or of different materials.

Depending on the type of cap 1' or 1 in question, namely crown cap or screw cap, the side portion 4 is shaped differently, as explained below.

In cap 1' (see FIG. 2), the portion 4 is crown shaped and extends annularly from the upper portion 3 and is inclined in relation thereto. As an option, there is a highly-deformable area (not shown) between the upper portion 3 and the side portion 4 so as to ensure easy angulation of the latter in relation to the former. The bottle 10 has a shoulder 14 at the end 12*a* of the neck 12 on which the crown engages, thus ensuring the connection between the cap 1' and the bottle 10 in a known way.

In the cap 1 (see FIG. 1), as an alternative, the portion 4 is cylindrical in shape and includes a thread 7 capable of engaging in a counter-thread 11 made in the bottle 10 in a known way. The thread 7 can be made either directly in the portion 4, for example by plastic deformation by a pressure or force of sufficient intensity to cause the material forming the side portion 4 to penetrate inside the counter-thread 11 thus forming the thread 7, or by moulding (for example for plastics caps). Alternatively, an additional annular element may be provided (not shown) fixed integrally—for example glued—to the inner surface of the side portion 4, defined as the surface is which is in contact with the wall of the neck 12 of the bottle 10, on which the above-mentioned thread 7 is made, so that the outer surface, i.e. the surface opposite the inner surface of the portion 4, is substantially smooth. In addition, in the screw cap 1, the central 3 and side 4 portions are substantially perpendicular and the latter extends along the neck of the bottle for a greater or lesser length, depending on the design of cap 1 chosen.

The side portion 4 can have additional characteristics that are known to an expert within this field.

The characteristics common to both caps 1 and 1' shall be described below and any differences or necessary adaptations due to the type of cap used shall in themselves be minimal.

The cap 1 or 1' comprises an insert 8 fixed to the body 2, in a position facing the inner surface 3*a* of the upper portion 3.

In a first embodiment described here with reference to FIGS. 1 to 4, the insert 8 comprises a sealing element 9, preferably disc-shaped, which extends substantially completely to cover the inner surface 3*a* so that, on securing the cap 1, 1' to the bottle 10, at its peripheral region it is compressed between the body 2 and the end portion 12*a* of the neck 12 of the bottle, ensuring a substantially hermetic seal of the cap 1, 1' on the bottle. In another example not shown, the seal 9 may extend also to cover a portion of the inner surface of the side portion 4.

The sealing element 9 is made of a material that acts as a barrier to the passage of oxygen, such as aluminium or a polymer material such as polypropylene and/or PVDC.

The sealing element may have a multi-layer structure and may be made in a different way depending on the level of oxygen seal required over time.

The composition of the sealing element 9 is chosen so as to minimise (the longer the estimated ageing time of the liquid inside the bottle, the more important this is) the exchange of gas between the inside and the outside of the bottle due to any "leakage" that may take place at the interface between the side portion 4 that acts as a connecting element to the bottle 10, and the bottle itself, an exchange which according to one of the main objects of the invention should rather be controlled.

For this purpose, the sealing element 9 has a passage 17, extending along a longitudinal axis X of the seal 9, which generally—but not necessarily—coincides with the axis of the neck of the bottle 10, and is made in a position such as to result in communication of fluid with at least one through-hole 20 made in the upper portion 3.

Preferably, the passage 17, which defines a first and second upper and lower edge 17*a* and 17*b* opposite each other, has a circular cross-section, is made in the centre of the sealing element 9, and has a diameter in the order of about 10-15 mm.

Since the seal 9 is fixed on the upper portion 3, the upper edge 17*a* of the passage 17 is partially closed by the surface 3*a* of the upper portion 3.

The through-hole 20 is preferably made in the upper portion 3 of the body 2 in a vertically offset position in relation to the through-axis 17, for the reason explained below. More preferably, the upper portion 3 has a plurality of through-holes 20, numbering 2 or 4 for example. By way of example, the holes 20 are 1 mm in diameter.

The insert 8 also comprises a permeating element formed, in this first embodiment, by a membrane 16 arranged so as to close, at least in part, the remaining free lower edge 17*b* of the passage 17. The characteristics of the membrane 16, described in detail below, are such as effectively to regulate the passage of oxygen, from the passage 17 to the inside of the bottle 10.

The membrane 16 may be fixed to the sealing element 9 directly, for example by gluing or over-moulding or by means of an intermediate element as in the embodiment described here. In this case, in fact, the membrane 16, preferably disc-shaped and being smaller in size than the longitudinal section of the passage 17, for example having a diameter of 5 mm, is positioned on one end 22*a* of a closing element 22 closing an end of a through-hole 23 made therein. The closing element 22 and the membrane 16 fixed to it is clearly shown in FIGS. 3 and 4. Preferably, on the end 22*a* of the closing element 22 there is a recess 25, inside which a membrane 16 is housed. The hole 23 extends substantially along the axis X, like the passage 17, and is therefore substantially perpendicular to the upper portion 3.

The closing element 22 bearing the membrane 16 is therefore fixed, for example by gluing, or ultrasound welding, to the seal 9 closing off the free edge 17*b* of the passage 17, thus defining an air chamber 24 delimited by the wall of the passage 17, the surface 3*a* of the upper portion 3 and the end 22*a* of the closing element 22, which enables a controlled flow of air between the environment outside and that inside the bottle 10. Alternatively, the closing element 22 may be obtained by co-moulding with the sealing element 9 or by over-moulding the latter.

It is important that the fixing between the closing element 22 and the seal 9 is such that the passage of air between the outside and inside of the bottle 10 occurs only through the membrane 16 (which in turn is "seal" fixed, for example by gluing, ultrasound welding or over-moulding, onto the element 22 to prevent any leakage of air) so as to obtain an extremely controlled passage of gas.

Advantageously, the presence of the air chamber 24 enables increased and controlled cleanliness of the membrane 16: in fact, as the holes 20 are made preferably in a vertically offset position (not along the centreline) in relation to the membrane 16, any particles and dust that penetrate into the air chamber 24 through the holes 20, are deposited onto an area of the surface at the end 22*a* not onto the membrane 16 which does not therefore lose any "useful" or transpiring surface and therefore, even in the presence of dirt, the quantity of air that can be exchanged between the outside and inside environments of the bottle 10, through the holes 20, then through the passage 17, then through the membrane 16 and lastly through the hole 23, remains substantially unchanged.

In a first variant of the embodiment, illustrated in FIG. 5, the holes 20 are open on the inclined sides of a protuberance 3*c* in a central area of the upper portion 3.

Alternatively, the holes 20 can be protected by a thin film that is permeable to oxygen.

In a second variant of the invention, illustrated in FIGS. 6*a* and 6*b*, the upper 3 and side portion 4 of the body 2 of the cap are integral and the passage of air up to the passage 17, and therefore to the membrane 16, is achieved through one or more communication channels made directly on the sealing element 9. In a preferred embodiment, these channels are in the form of grooves 20*a*, made on the surface of the sealing element 9 facing the inner surface 3*a* of the body 2 and extending between the edge 17*a* of the passage 17 and the outer perimetric margin of the sealing element 9.

These variants, particularly the second one, prevent the accumulation of dirt on the membrane 16.

Preferably, the closing element 22, preferably cylindrical, has an annular projection 28 (see FIG. 3) at its end 22*a* for fixing to the sealing element 9 so as to increase the size of the air chamber 24 as desired.

Advantageously, according to the invention, semi-finished pieces can be made comprising a continuous sheet made of the material forming the sealing element 9 (for example a multi-layered material) on which there is a plurality of holes, preferably regularly spaced, each of which the membrane 16 closes over. Preferably, over each hole, which substantially represents the passage 17, the closing element 22 is fixed, in its turn perforated (by the hole 23) and bearing the membrane 16. The semi-finished piece thus made is then punched as required, obtaining at each hole/passage 17 an insert 8 as described above. Advantageously, with just one semi-finished piece it is possible to obtain inserts of different sizes (depending on the diameter of the punch used to cut the various inserts 8 from the semi-finished piece) to be applied to caps 1, 1' of different diameters.

The membrane 16 is hydrophobic and substantially impermeable to liquids, so as not to allow the liquid contained in the bottle to pass through it.

The membrane 16 is furthermore made of a polymer material having characteristics such as to enable a flow of oxygen sufficient for the process of ageing the wine contained in the bottle, the latter being quantifiable at about 0.1-5 milligrams (mg) per month, depending on the type of wine. To be precise, for most of the wines in question, the monthly flow of oxygen that must pass from the outside to the inside of the bottle in order to achieve a proper ageing of the wine is between 0.2 and 2 mg.

This flow, taking appropriate account of a minimum constant amount of oxygen inevitably passing between the sealing element and the bottle and considering the same differential partial pressure of oxygen between the two sides of the membrane, depends substantially on the surface of the membrane exposed to the flow, on its thickness and on its permeability to oxygen.

The surface area of the membrane 16 exposed to the flow of oxygen coincides, in the case described here, with the area of the section of the hole 23, the diameter of which varies between about 1 and 10 mm, preferably between 3 and 10 mm. As a result, the surface area in question is between 0.7 and 78.5 $mm^2$, preferably between 7.1 and 78.5 $mm^2$.

By contrast, the thickness of the membrane 16 is between 0.01 and 10 mm, preferably between 0.5 and 3.5 mm.

Note that in the preferred embodiment described here, there is only one membrane; however it is of course possible to control the flow of oxygen by means of several membranes. In this case, it will still be possible to create an equivalent total area and an equivalent total thickness defined as the area and thickness of a hypothetical membrane which, alone, offers the same resistance to the flow of oxygen as the plurality of membranes provided in the cap.

The definition of these equivalent total areas and thicknesses will naturally depend on how the membranes are arranged in the cap 1, 1', for example on whether the latter are arranged in series on the same passage or in parallel on different passages. In fact, an insert 8 could be provided with a plurality of holes 23, for example all parallel to each other along axis X, and one end of each hole 23 could be closed by a membrane 16 having the characteristics described above.

The permeability to oxygen of the membrane 16 at ambient temperature, set at 20° C., is between $10^{-6}$ and $10^{-10}$ ($Ncm^3*cm/cm^2*cm_{Hg}*s$), preferably between $10^{-7}$ and $10^{-10}$ ($Ncm^3*cm/cm^2*cm_{Hg}*s$).

The membrane 16 may be of a compact type, i.e. substantially having no porosity, in which case the flow of the gas concerned through the membrane occurs by diffusion in the solid phase, or of the microporous type, in which case the flow of gas occurs principally through the micropores (Fick's Laws of Diffusion).

In the case of membranes of a microporous type, the membrane must have, according to a further aspect of the invention, a molecular cut-off of less than 50 kdaltons.

The molecular cut-off is a measurement correlated to the size of the micropores and indicates the maximum molecular weight of the molecules capable of crossing the membrane, passing through its holes.

The measurement of the size of the micropores assumes considerable importance if the cap 1, 1' is used in bottles containing wine that is to undergo a long ageing process. Indeed, a low molecular cut-off substantially prevents the passage of heavy complex molecules from and towards the inside of the bottle, including molecules of compounds that are important for the conservation and/or production of the final organoleptic properties required of the wine contained in it.

In particular, a microporous membrane is preferred that has a molecular cut-off of between 1 and 20 kDaltons, more preferably between 1 and 10 kDaltons.

As regards membranes of a compact type, some indicative and non-exhaustive examples of materials suitable for creating membranes of a compact type having permeability levels that fall within the above-mentioned limits are represented by:

- silicon rubbers, such as vulcanised polydimethyl siloxane (PDMS) or polyoxydimethyl silylene;
- polydienes and copolymers thereof, such as polybutadiene, polyisoprene, polyisoprene hydrochloride, polymethyl-1-pentenylene, hydrogenated polybutadiene, poly(2-methyl-1.3-pentadiene-co-4-methyl-1.3-pentadiene), vulcanised trans rubber, polychloroprene and butadiene acrylonitrile copolymer;
- cellulose derivatives, such as ethyl cellulose and cellulose acetobutyrate;
- styrene/olefin/diene-based copolymers such as styrene-ethylene-butene-styrene (SEBS) and styrene-ethylene-propylene-styrene (SEPS);
- polyoxides, such as poly(oxy-2.6-dimethyl-1.4-phenylene);
- polyolefins and derivatives thereof, such as low-density polyethylene or ethylene-vinylacetate copolymer (EVA);
- fluorinated polymers and copolymers, such as polytetrafluoroethylene and tetrafluoroethylene-hexafluoropropene copolymer.

Some examples of membranes made of these materials are given in Table 1.

The membrane 16 can also be of a composite type, made of just one layer or of several superimposed layers, each of which can be made of any polymer, homopolymer, polymer mixture or copolymer material, even of a composite type and loaded with an inorganic load. One of the layers may also comprise an inorganic, ceramic or zeolithic material.

The materials that make up the above-mentioned membranes can be appropriately nanoloaded, for example with organomodified nanoclays, silica, $TiO_2$, magnesium oxide, titanium dioxide, etc. so as to achieve the desired permeability to oxygen.

Figure 7:
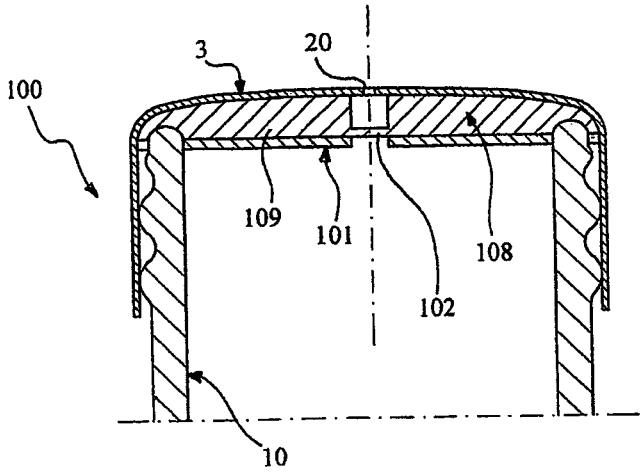
FIG. 7 is a longitudinal-section schematic view of a third embodiment of a cap with insert according to the invention.

A cap 100, showing a third embodiment of the invention, is schematically represented in FIG. 7, in which parts similar to those in caps 1 and 1' of the preceding embodiments are identified by the same reference numerals.

The cap 100 comprises an insert 108 in which the sealing element 109 is part of the permeating element, forming therewith a single and homogeneous body made, for example, by moulding, of a material that is to permeable to oxygen, like the membrane 16 of the preceding embodiments. In order to prevent the oxygen from passing through the insert 108 and entering the bottle 10 in an uncontrolled manner, the sealing element 109 is connected to a film 101 which is impermeable to oxygen. The film 101 extends over the entire surface of the sealing element 109 facing the interior of the bottle, except for one central region 102, through which the controlled passage of oxygen occurs (alternatively, the film is connected to both surfaces of the sealing element 109). The region 102 is located at the hole 20, in fluid communication with the environment outside the bottle and has a passage area and thickness like those of the membrane 16 described in the preceding embodiments. In particular, the region 102 can have a reduced thickness compared to the thickness of the sealing element 109.

The main advantage connected with this embodiment is that the insert is easier to produce.

Figure 8:
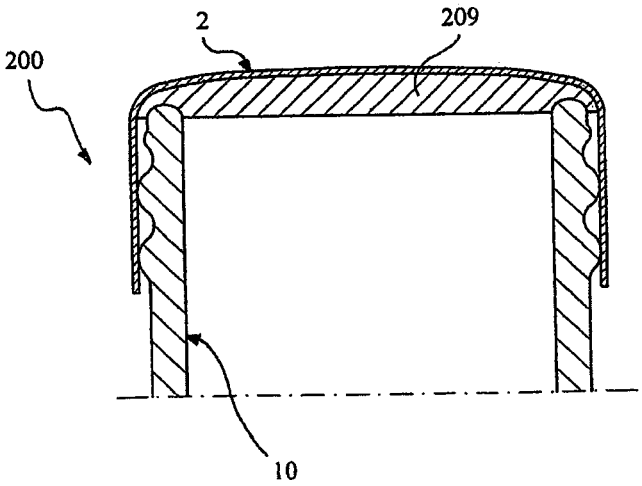
FIG. 8 is a longitudinal-section schematic view of a fourth embodiment of a cap with insert according to the invention.

FIG. 8 shows a cap 200, forming a fourth embodiment of the invention. In this case too, the permeating element is formed by the sealing element 209, as in the preceding embodiment, to which however no film is connected to act as a barrier to the oxygen and so the latter diffuses through the sealing element 209 directly into the bottle's interior, after having been contact-joined thereto through the space defined between the neck of the bottle and the side portion 4 of the body 2 of the cap (the size of the space in the figure is exaggerated for the sake of clarity). Advantageously, the body 2 requires no holes.

In this case the sizes and materials must necessarily be carefully chosen since the flow of oxygen through the cap is controlled only by means of the thickness and permeability of the material chosen to make it, as the size of the surface is determined by the sizes of commercially available bottles.

In particular, the material is chosen from the group made up of rubbers, preferably of the diene or silicone type (in a form that favours platinum crosslinking), from block styrene-based copolymers such as SEBS and SEPS, as well as from cellulose derivatives such as ethyl cellulose.

Figure 9:
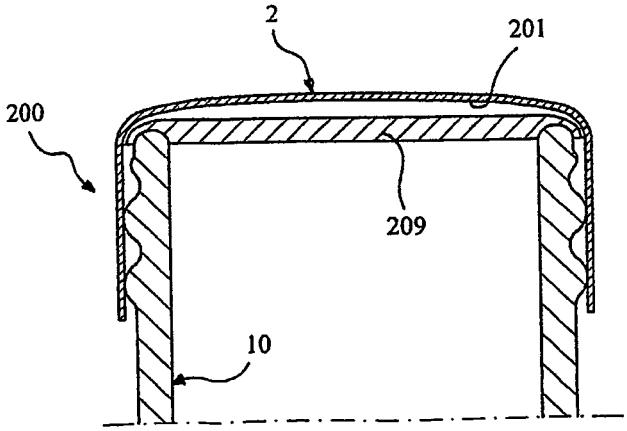
FIG. 9 is a longitudinal-section schematic view of a variant of the cap with insert shown in FIG. 8.

FIG. 9 shows a variant of the cap 200, identified as a whole by 200', in which the sealing element 209, made from families of materials identified in the preceding example, is fixed to the side portion 4 of the body 2 whereas it is separated, possibly with the aid of spacers, from the upper portion 3 of the body 2 of the cap, thus creating an air chamber 201.

Note that the embodiments shown in FIGS. 8 and 9 are very well suited to production by sheet punching, with obvious economic advantages as regards production.

EXAMPLES

A series of caps made according to the above-described embodiments have been made, using membranes with compact-type materials, have differing levels of permeability and different areas and thicknesses.

All of the embodiments of caps made have been pressure-tested at constant temperature, comparable with the ambient conditions in which the process of ageing a wine in a bottle normally occurs.

The test results are set out in Tables 1 and 2 which list the monthly flows of oxygen through a cap fitted with a membrane made of a material with a specific permeability (indicated by Perm), thickness (indicated by T, in mm) and diameter (indicated by D, in mm).

The results that meet the flow requirements needed for a correct wine-ageing process are those between 0.2 and 2 mg/month and are shown in bold type.

Table 1 shows the results of tests performed on caps made according to the embodiment shown in FIGS. 1-4 and FIG. 7, which are all operationally equivalent. All of the materials have been tested on diameters of 3 and 10 mm and on thickness of 1 and 3.5 mm.

By contrast, Table 2 shows the results of tests performed on caps made according to the embodiment shown in FIG. 8, in which the diameter of the sealing element was 28.8 mm, closed over a bottle, the opening of which had an external diameter of 26 mm and an internal diameter of 19.3 mm. The tests were carried out using two different thicknesses: 1 and 2 mm.

Table 3 shows the results of tests performed on caps made according to the embodiment shown in FIG. 9, in which the diameter of the sealing element was 28.8 mm. The caps were closed over a bottle, the opening of which had an external diameter of 26 mm and an internal diameter of 19.3 mm. The tests were performed using two different thicknesses: 1 and 2 mm. It was observed that the flow of oxygen is substantially independent of the height of the air chamber 201 and that this flow is much higher compared to the embodiment shown in FIG. 8 (Table 2), which advantageously enables a wider choice of the most suitable material.

TABLE 1

| | Perm | Flow of oxygen (mg/month) | | | |
|---|---|---|---|---|---|
| Material | $Ncm^3*cm/(cm^2*cm_{Hg}*s)$ | T = 1 mm D = 3 mm | T = 1 mm D = 10 mm | T = 3.5 mm D = 3 mm | T = 3.5 mm D = 10 mm |
| PDMS | 8.00E−08 | 3.35 | 37.18 | **0.96** | 10.62 |
| Poly(oxydimethylsilene) with 10% Scantocel CS filler | 4.88E−08 | 2.04 | 22.68 | **0.58** | 6.48 |
| SEPS (Megol K) | 1.88E−08 | **0.79** | 8.74 | **0.22** | 2.50 |
| Polyisoprene hydrochloride | 5.39E−09 | **0.23** | 2.50 | 0.06 | **0.72** |
| Polymethyl-1- | 3.22E−09 | 0.13 | **1.50** | 0.04 | **0.43** |

TABLE 1-continued

| Material | Perm Ncm$^3$*cm/ (cm$^2$*cm$_{Hg}$*s) | Flow of oxygen (mg/month) T = 1 mm D = 3 mm | T = 1 mm D = 10 mm | T = 3.5 mm D = 3 mm | T = 3.5 mm D = 10 mm |
|---|---|---|---|---|---|
| pentenylene | | | | | |
| Amorphous polyisoprene | 2.34E−09 | 0.10 | **1.09** | 0.03 | **0.31** |
| Polybutadiene | 1.90E−09 | 0.08 | **0.88** | 0.02 | **0.25** |
| SEBS (Kraton G1650) | 1.39E−09 | 0.06 | **0.64** | 0.02 | 0.18 |
| SEBS (Kraton G2705) | 2.51E−09 | 0.10 | **1.16** | 0.03 | **0.33** |
| Poly(oxy-2.6-dimethyl-1.4-phenylene) | 1.58E−09 | 0.07 | **0.74** | 0.02 | **0.21** |
| Ethyl cellulose | 1.46E−09 | 0.06 | **0.68** | 0.02 | 0.19 |
| Hydrogenated polybutadiene | 1.13E−09 | 0.05 | **0.52** | 0.01 | 0.15 |
| Poly(2-methyl-1.3-pentadiene-co-4-methyl-1.3-pentadiene) 85/15 | 1.00E−09 | 0.04 | **0.46** | 0.01 | 0.13 |
| Polybutadiene-co-acrylonitrile 80/20 | 8.18E−10 | 0.03 | **0.38** | 0.01 | 0.11 |
| Vulcanised trans rubber-purified gutta-percha | 6.17E−10 | 0.03 | **0.29** | 0.01 | 0.08 |
| Polytetrafluoroethylene-co-hexafluoropropene | 4.89E−10 | 0.02 | **0.23** | 0.01 | 0.06 |
| Cellulose acetobutyrate | 4.73E−10 | 0.02 | **0.22** | 0.01 | 0.06 |
| Polytetrafluoroethylene (PTFE) | 4.26E−10 | 0.02 | **0.20** | 0.01 | 0.06 |
| Fluorinated polymer | 4.22E−10 | 0.02 | **0.20** | 0.01 | 0.06 |
| Polychloroprene | 3.94E−10 | 0.02 | 0.18 | 0.00 | 0.05 |
| Polybutadiene-co-acrylonitrile 73/27 | 3.86E−10 | 0.02 | 0.18 | 0.00 | 0.05 |
| LDPE (low density polyethylene) | 2.93E−10 | 0.01 | 0.14 | 0.00 | 0.04 |

TABLE 2

| Material | Perm Ncm$^3$*cm/ (cm$^2$*cm$_{Hg}$*s) | Flow of oxygen (mg/month) T = 1 mm | T = 2 mm |
|---|---|---|---|
| PDMS | 8.00E−08 | 7.65 | 12.33 |
| Poly(oxydimethylsilene) with 10% Scantocel CS filler | 4.88E−08 | 4.67 | 7.52 |
| SEPS (Megol K) | 1.88E−08 | **1.80** | 2.90 |
| Polyisoprene hydrochloride | 5.39E−09 | **0.51** | **0.83** |
| Polymethyl-1-pentenylene | 3.22E−09 | **0.31** | **0.50** |
| Amorphous polyisoprene | 2.34E−09 | **0.22** | **0.36** |
| Polybutadiene | 1.90E−09 | 0.18 | **0.29** |
| SEBS (Kraton G1650) | 1.39E−09 | 0.13 | **0.21** |
| SEBS (Kraton G2705) | 2.51E−09 | **0.24** | **0.39** |
| Poly(oxy-2.6-dimethyl-1.4-phenylene) | 1.58E−09 | 0.15 | **0.24** |
| Ethyl cellulose | 1.46E−09 | 0.14 | **0.23** |
| Hydrogenated polybutadiene | 1.13E−09 | 0.11 | 0.17 |
| Poly(2-methyl-1.3-pentadiene-co-4-methyl-1.3-pentadiene) 85/15 | 1.00E−09 | 0.10 | 0.15 |
| Polybutadiene-co-acrylonitrile 80/20 | 8.18E−10 | 0.08 | 0.13 |
| Vulcanised trans rubber-purified gutta-percha | 6.17E−10 | 0.06 | 0.10 |
| Polytetrafluoroethylene-co-hexafluoropropene | 4.89E−10 | 0.05 | 0.08 |
| Cellulose acetobutyrate | 4.73E−10 | 0.05 | 0.07 |
| Polytetrafluoroethylene (PTFE) | 4.26E−10 | 0.04 | 0.07 |
| Fluorinated polymer | 4.22E−10 | 0.04 | 0.06 |
| Polychloroprene | 3.94E−10 | 0.04 | 0.06 |

TABLE 2-continued

| Material | Perm Ncm$^3$*cm/ (cm$^2$*cm$_{Hg}$*s) | Flow of oxygen (mg/month) T = 1 mm | T = 2 mm |
|---|---|---|---|
| Polybutadiene-co-acrylonitrile 73/27 | 3.86E−10 | 0.04 | 0.06 |
| LDPE (low density polyethylene) | 2.93E−10 | 0.03 | 0.05 |

TABLE 3

| Material | Perm Ncm$^3$*cm/ (cm$^2$*cm$_{Hg}$*s) | Flow of oxygen (mg/month) T = 1 mm | T = 2 mm |
|---|---|---|---|
| PDMS | 8.00E−08 | 48.34 | 29.28 |
| Poly(oxydimethylsilene) with 10% Scantocel CS filler | 4.88E−08 | 29.49 | 17.86 |
| SEPS (Megol K) | 1.88E−08 | 11.36 | 6.88 |
| Polyisoprene hydrochloride | 5.39E−09 | 3.25 | **1.97** |
| Polymethyl-1-pentenylene | 3.22E−09 | **1.94** | **1.18** |
| Amorphous polyisoprene | 2.34E−09 | **1.41** | **0.86** |
| Polybutadiene | 1.90E−09 | **1.15** | **0.70** |
| SEBS (Kraton G1650) | 1.39E−09 | **0.84** | **0.51** |
| SEBS (Kraton G2705) | 2.51E−09 | **1.51** | **0.92** |
| Poly(oxy-2.6-dimethyl-1.4-phenylene) | 1.58E−09 | **0.96** | **0.58** |
| Ethyl cellulose | 1.46E−09 | **0.88** | **0.54** |
| Hydrogenated polybutadiene | 1.13E−09 | **0.68** | **0.41** |
| Poly(2-methyl-1.3- | 1.00E−09 | **0.60** | **0.37** |

TABLE 3-continued

| Material | Perm $Ncm^3*cm/(cm^2*cm_{Hg}*s)$ | Flow of oxygen (mg/month) T = 1 mm | T = 2 mm |
|---|---|---|---|
| pentadiene-co-4-methyl-1.3-pentadiene) 85/15 | | | |
| Polybutadiene-co-acrylonitrile 80/20 | 8.18E−10 | **0.49** | **0.30** |
| Vulcanised trans rubber-purified gutta-percha | 6.17E−10 | **0.37** | **0.23** |
| Polytetrafluoroethylene-co-hexafluoropropene | 4.89E−10 | **0.30** | 0.18 |
| Cellulose acetobutyrate | 4.73E−10 | **0.29** | 0.17 |
| Polytetrafluoroethylene (PTFE) | 4.26E−10 | **0.26** | 0.16 |
| Fluorinated polymer | 4.22E−10 | **0.25** | 0.15 |
| Polychloroprene | 3.94E−10 | **0.24** | 0.14 |
| Polybutadiene-co-acrylonitrile 73/27 | 3.86E−10 | **0.23** | 0.14 |
| LDPE (low density polyethylene) | 2.93E−10 | 0.18 | 0.11 |

The invention claimed is:

1. An insert for a mechanical clamping cap of a screw and crown type, for closure of bottles, said insert comprising a sealing element capable of being compressed in one part between a body of a bottle cap and a portion of said bottle when said cap is closed over said bottle, and comprising a permeating element, said permeating element being impermeable to liquids and having a permeability to oxygen measured at 20° C. of between $10^{-6}$ and $10^{-10}$ $Ncm^3*cm/cm^2*cm_{Hg}*s$, wherein said permeating element is of a compact type, said permeating element being positioned and configured to close a passage made in said bottle cap between an inside and outside of the bottle, and having a thickness and surface such as to control the flow of oxygen between the inside and outside of the bottle, with the cap fitted, between 0.1 and 5 milligrams per month; said permeating element being positioned such that passage of air between the outside and inside of a bottle over which said cap is closed, occurs only through the permeating element, so as to enable a flow of oxygen into and out of said bottle sufficient for the process of aging wine contained in the bottle;

wherein said insert is configured to be fixed to a portion of a surface of said body of said bottle cap.

2. The insert according to claim 1, wherein said permeating element has a permeability to oxygen measured at 20° C. of between $10^{-7}$ and $10^{-10}$ ($Ncm^3*cm/cm^2*cm_{Hg}*s$).

3. The insert according to claim 2, wherein said sealing element comprises a material that is substantially impermeable to oxygen and said permeating element comprises a membrane extending to close at least a portion of a passage crossing said sealing element and capable of placing the interior of said bottle in communication with an environment outside the bottle.

4. The insert according to claim 3, wherein on said sealing element there is at least one communication channel between the environment outside the bottle and said passage from the side of said membrane that faces an environment inside the bottle.

5. The insert according to claim 4, wherein said at least one communication channel comprises at least one groove made on a surface of said sealing element designed to face said body.

6. The insert according to claim 3, wherein said passage comprises a first and second edge opposite each other, said first edge being designed to be closed by said surface of said body of the cap and said second edge being closed at least in part by said membrane.

7. The insert according to claim 6, wherein said membrane is integrally fixed to said sealing element.

8. The insert according to claim 6, including a closing element closing off said second edge of said passage, there being a through-hole, in said closing element, closed by said membrane.

9. The insert according to claim 8, wherein said closing element has at one end a recess, inside which said membrane is housed.

10. The insert according to claim 8, wherein said closing element includes a perimetric projection for fixing to said sealing element.

11. The insert according to claim 8, wherein said closing element is made in one piece with said sealing element by moulding.

12. The insert according to claim 8, wherein said closing element is obtained by co-moulding with said sealing element or by over-moulding said sealing element.

13. The insert according to claim 8, wherein said membrane is fixed to said closing element by means selected from the group consisting of over-moulding, ultrasound welding, and gluing.

14. The insert according to claim 1, wherein said sealing element is part of said permeating element and forms a single and homogeneous body therewith.

15. The insert according to claim 14, wherein said sealing element is connected to a film that is impermeable to oxygen over the entire surface except for a region with a pre-defined area, through which the controlled passage of oxygen occurs.

16. The insert according to claim 15, wherein said region has a reduced thickness.

17. The insert according to claim 14, wherein said sealing element has a substantially uniform thickness and is made of a material selected from the group consisting of rubbers, block styrene-based copolymers and cellulose derivatives.

18. The insert according to claim 1, wherein said permeating element is of a compact type and comprises a material selected from the group consisting of silicone rubbers, polydienes and copolymers thereof, cellulose derivatives, styrene/olefin/diene copolymers, polyoxides, polyolefins and derivatives thereof, as well as fluorinated polymers and copolymers.

19. The insert according to claim 18, wherein said permeating element comprises a material selected from the group consisting of polybutadiene, polyisoprene, polyisoprene hydrochloride, polymethyl-1-pentenylene, ethyl cellulose, styrene-ethylene-butene-styrene copolymer (SEBS), styrene-ethylene-propylene-styrene copolymer (SEPS), poly (oxy-2.6-dimethyl-1.4-phenylene), hydrogenated polybutadiene, poly(2-methyl-1.3-pentadiene-co-4-methyl-1.3-pentadiene), butadiene-acrylonitrile copolymer, vulcanised trans rubber, tetrafluoroethylene-hexafluoropropene copolymer, cellulose acetobutyrate, and fluorinated polymers.

20. The insert according to claim 19, wherein said permeating element is silicone-rubber-, SEBS-, SEPS- or EVA-based.

21. The insert according to claim 1, wherein said permeating element defines an equivalent total surface for the passage of oxygen, said equivalent total surface being between 0.7 and 78.5 $mm^2$.

22. The insert according to claim 1, wherein said permeating element defines an equivalent total thickness of surface affected by the passage of oxygen, said equivalent total thickness being between 0.01 and 10 mm.

23. A mechanical clamping cap for the closure of bottles, comprising a body including an upper portion from the periphery of which extends a side portion shaped so as to be removably connected at an opening of said bottle and an insert fixed to a surface of said body facing the interior of the bottle when the cap is connected at said opening, wherein the insert comprises an insert according to claim 1.

24. The cap according to claim 23, wherein on said upper portion of said body there is at least one hole to place a permeating element of said insert in communication with an environment outside said bottle.

25. The cap according to claim 24, wherein said at least one hole is made in a position that is vertically offset in relation to said permeating element.

26. The cap according to claim 24, wherein on said upper portion of said body there is a protuberance and said at least one hole is made on sides of said protuberance.

27. The cap according to claim 23, wherein said cap is of the screw type.

28. The cap according to claim 23, wherein said cap is of the crown type.

29. A semi-finished piece comprising a sheet comprising a plurality of passages, capable of being punched so as to form a plurality of inserts for screw or crown caps according to claim 1.

30. The insert according to claim 18, wherein said permeating element comprises a material selected from the group consisting of polytetrafluoroethylene, polychloroprene, low density polyethylene and ethylene vinylacetate copolymer (EVA).

31. The insert according to claim 21, wherein said permeating element defines an equivalent total surface for the passage of oxygen, said equivalent total surface being between 7.1 and 78.5 $mm^2$.

32. The insert according to claim 22, wherein said permeating element defines an equivalent total thickness of surface affected by the passage of oxygen, said equivalent total thickness being between 0.5 and 3.5 mm.

* * * * *